US009303656B2

(12) United States Patent
Takahashi et al.

(10) Patent No.: US 9,303,656 B2
(45) Date of Patent: Apr. 5, 2016

(54) AXIAL COMPRESSOR

(75) Inventors: Yasuo Takahashi, Mito (JP); Chihiro Myoren, Tokai (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 893 days.

(21) Appl. No.: 13/272,635

(22) Filed: Oct. 13, 2011

(65) Prior Publication Data

US 2012/0093637 A1 Apr. 19, 2012

(30) Foreign Application Priority Data

Oct. 14, 2010 (JP) ..... 2010-231085

(51) Int. Cl.
*F04D 29/32* (2006.01)
*F04D 29/54* (2006.01)

(52) U.S. Cl.
CPC ..... *F04D 29/542* (2013.01); *F04D 29/324* (2013.01); *F04D 29/544* (2013.01); *Y10T 29/49316* (2015.01)

(58) Field of Classification Search
CPC ..... F05D 2240/123; F05D 2240/124; F05D 2240/305; F05D 2240/306; F01D 9/04
USPC ..... 415/191; 416/242, 243
See application file for complete search history.

(56) References Cited

U.S. PATENT DOCUMENTS 5,292,230 A * 3/1994 Brown ..... 416/223 A
5,395,071 A 3/1995 Felix
5,554,000 A 9/1996 Katoh et al.
6,338,609 B1 * 1/2002 Decker et al. ..... 415/173.1
6,638,021 B2 * 10/2003 Olhofer et al. ..... 416/242
6,682,301 B2 * 1/2004 Kuhne ..... 415/181
6,776,582 B2 * 8/2004 Segawa et al. ..... 416/223 R
2002/0172594 A1 11/2002 Segawa et al.

FOREIGN PATENT DOCUMENTS

JP 7-12094 A 1/1995
JP 7-83196 A 3/1995
JP 8-135597 A 5/1996
JP 2001-165096 A 6/2001
JP 2001-234893 A 8/2001

OTHER PUBLICATIONS

Japanese Office Action with English translation thereof dated Aug. 20, 2013 {Four (4) pages}.
Seymour Lieblein, "Experimental Flow in Two-Dimensional Cascades," Aerodynamics Design of Axial-Flow Compressors, National Aeronautics and Space Administration, 1965, pp. 183-226.
Extended European Search Report dated Aug. 5, 2014 (seven (7) pages).

* cited by examiner

*Primary Examiner* — Nathaniel Wiehe
*Assistant Examiner* — Michael Sehn
(74) *Attorney, Agent, or Firm* — Crowell & Moring LLP

(57) ABSTRACT

An axial compressor includes a plurality of stator vanes attached to an inner surface of a casing defining an annular flow path and a plurality of rotor blades attached to a rotating rotor defining the annular flow path. A flow path is defined between a pressure surface of a stator vane and a suction surface of a stator vane, the vanes being circumferentially adjacent to each other, or between a pressure surface of a rotor blade and a suction surface of a rotor blade, the blades being circumferentially adjacent to each other. The flow path is formed so that a throat portion at which a flow path width is minimized is provided on the upstream side of 50% of an axial chord length.

4 Claims, 8 Drawing Sheets

(a)

(b)

(a)

(b)

AXIAL COMPRESSOR

BACKGROUND OF THE INVENTION

1. Field of the Invention

The present invention relates generally to axial compressors for gas turbines and industrial applications, and in particular to an axial compressor having high-performance airfoils.

2. Description of the Related Art

NACA 65 series airfoils have heretofore been applied to subsonic airfoils located on the downstream side in an axial compressor. As described in "Aerodynamic Design of Axial-Flow Compressors", National Aeronautics and Space Administration, 1965, (NACA, SP-36), the NACA 65 series airfoils are developed by an organized and comprehensive experimental research using a Wind Tunnel. In recent years, axial compressors have required higher loading combining a higher pressure ratio with cost reduction resulting from a reduction in the number of stages. A subsonic airfoil in the downstream stage of a high loaded compressor increases a secondary flow due to the growth of an endwall boundary layer. Therefore, corner stall occurs on a blade surface, so that a conventional airfoil may provably increase a secondary loss. The application of a high performance airfoil that can control the corner stall is an important technology to improve the performance of a high loaded compressor.

JP,A 8-135597 discloses a method of controlling a secondary flow in an axial compressor. This method involves adjusting the shapes of airfoil end portions liable to cause a secondary flow. Specifically, the method involves adjusting a curvature radius of an airfoil centerline at a position close to the leading edge and at a position close to the trailing edge, with the position of the leading edge of the airfoil remaining fixed, so as to reduce a static pressure gradient on a pressure surface and on a suction surface.

SUMMARY OF THE INVENTION

The traditional technology as described in JP,A 8-135597, for reducing the secondary flow loss occurring close to the endwall, adopts a mainstream method as below. A staggered angle and an airfoil shape close to the endwall are improved to reduce a loading on an endwall portion of the airfoil. Consequently, the secondary flow loss and corner stall are controlled. However, there is concern that a loss may be increased at a portion other than the endwall portion where the loading is increased. In addition, unsteady fluid vibrations such as buffeting or the like due to the turbulence or separation of a flow are likely to lower the reliability of the compressor.

Accordingly, it is an object of the present invention to provide a high performance airfoil of a compressor that achieves a reduction in loss and ensuring of reliability.

According to an aspect of the present invention, there is provided an axial compressor including a number of stator vanes attached to an inner surface of a casing defining an annular flow path; and a number of rotor blades attached to a rotating rotor defining the annular flow path. A flow path is defined between a pressure surface of a stator vane and a suction surface of a stator vane, the vanes being circumferentially adjacent to each other, or between a pressure surface of a rotor blade and a suction surface of a rotor blade, the blades being circumferentially adjacent to each other. The flow path is formed so that a throat portion at which a flow path width is minimized may be provided on the upstream side of 50% of an axial chord length. In addition, an axial flow path width distribution extending from the leading edges to trailing edges of the vanes or the blades defining the flow path therebetween may have an inflection point on the downstream side of the throat portion.

The present invention can provide a high performance airfoil of a compressor that achieves a reduction in loss and ensuring of reliability.

DESCRIPTION OF THE PREFERRED EMBODIMENTS

Figure 2:
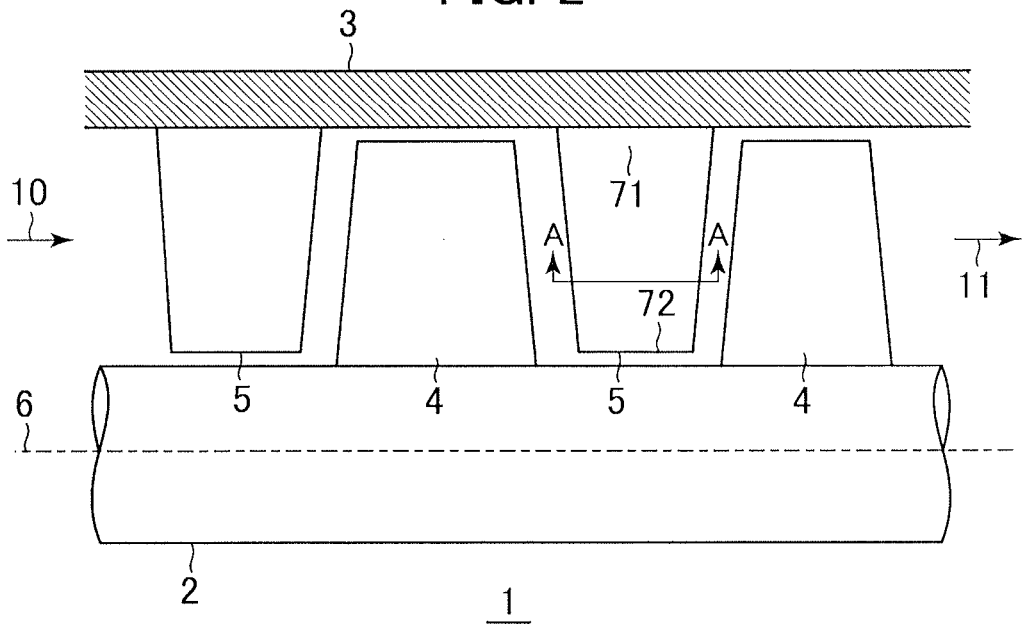
FIG. 2 is an axial cross-sectional view of an axial compressor according to an embodiment of the present invention.

FIG. 2 is a partial transverse sectional view of a multistage axial compressor to which an airfoil of the present invention is applied.

An axial compressor 1 includes a rotating rotor 2 to which a plurality of rotor blades 4 are attached and a casing 3 to which a plurality of stator vanes 5 are attached. An annular flow path is defined by the rotor 2 and the casing 3. The rotor blades 4 and the stator vanes 5 are alternately arranged in an axial direction. A single row of the rotor blades 4 and a single row of the stator vanes 5 constitute a stage. The rotor 2 is driven by a drive source (not shown) such as a motor or a turbine installed to have the same axis of rotation 6. An inlet flow 10 passes through the rotor blades 4 and the stator vanes 5 while being reduced in speed, and becomes a high temperature and pressure outlet flow 11.

An axial compressor is one in which rotor blades apply kinetic energy to an inlet flow and stator vanes change the direction of the flow for deceleration, thus, converting the kinetic energy into pressure energy for pressure rise. A boundary layer grows on an endwall of an annular flow path in such a flow field as described above. This increases a secondary flow loss on subsonic airfoils located on the downstream side in the axial compressor. Additionally, a highly loaded axial compressor that intends to increase a pressure ratio of the compressor and to reduce a cost due to a reduction in the number of stages enlarges corner stall on a blade surface. The corner stall is a key factor of the secondary flow loss. Thus, it has been a technical problem to create an airfoil shape that can control the corner stall.

Embodiments of the present invention can make uniform a static pressure gradient from a pressure surface to a suction surface with respect to a direction perpendicular to a flow, in a flow path between two adjacent blades or vanes. This can control a cross flow from the pressure surface to the suction surface between the rotor blades or between the stator vanes. Because of controlling the cross flow, corner stall occurring on the suction surface side can be reduced. Since the corner stall which is a key factor of the secondary flow loss can be controlled, a loss at a row of blades or vanes can be reduced, which leads to an improvement in the efficiency of the overall axial compressor.

Controlling the corner stall on the row of blades or vanes can improve an outlet flow angle. This can improve inlet flow angles of a row of stator vanes or rotor blades located on the downstream side of the row of the blades or vanes embodying the present invention. In addition, a reduction in the loss and higher performance at the stage composed of the rotor blades and the stator vanes can be achieved. Further, unsteady fluid vibrations such as buffeting or the like due to separation on a blade or vane surface can be avoided. Thus, the reliability of the axial compressor can be ensured.

An A-A section of the stator vane 5 is hereafter described by presenting a plurality of embodiments. However, the present invention is not limited to the stator vane but can similarly be applied to the rotor blade.

Figure 3:
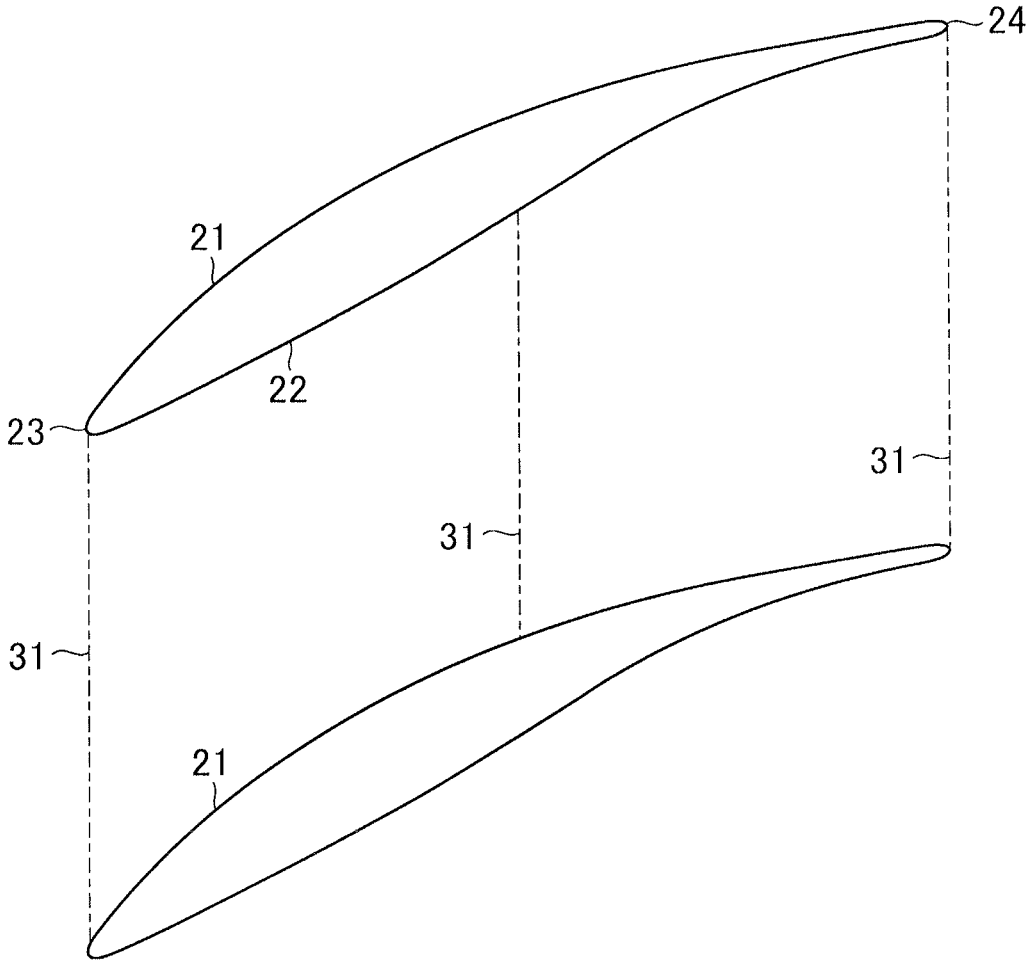
FIG. 3 is a two-dimensional cross-sectional view of axial compressor airfoils according to a first embodiment of the present invention.

A vane shape of the axial compressor according to a first embodiment is shown in FIG. 3. FIG. 3 illustrates a cylindrical section of two vanes circumferentially adjacent to each other, taken along the A-A section of the stator vane 5 of FIG. 2. The vane shape is composed of a suction surface 21, a pressure surface 22, a leading edge 23 and a trailing edge 24. A flow path is defined between the suction surface 21 of a vane and the pressure surface 22 of a vane adjacent to each other so as to have an circumferential flow path width 31 along an axial direction therebetween extending from the leading edges 23 to the corresponding trailing edges 24. An inlet flow moves in this flow path between the vanes.

Figure 1:
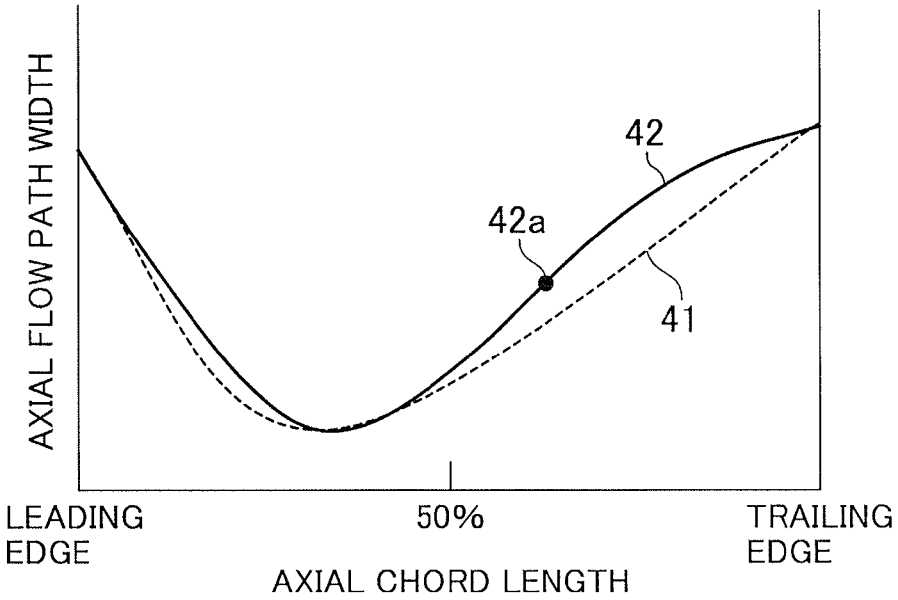
FIG. 1 is a distribution chart of a flow path width along an axial direction between airfoils according to an embodiment of the present invention.

FIG. 1 is a distribution chart of a flow path width with respect to an axial chord length. FIG. 1 shows comparison between a flow path width distribution 42 of the vane embodying the present invention indicated with a solid line and a flow path width distribution 41 of a traditional vane indicated with a dotted line. The traditional vane is such that the flow path width is minimized at a position close to 30% of the axial chord length and monotonously increased toward the trailing edge on the downstream side thereof. However, the flow path width distribution 42 according to the embodiment of the present invention has an inflection point 42*a* on the downstream side of a position where the axial flow path width is minimized (hereinafter, called the throat portion). As shown in FIG. 1, the axial flow path width distribution is formed such that the axial flow path width is maximized at the trailing edge without having a local maximum value as well as a local minimum value on the downstream side of the throat portion.

In other words, the axial flow path width distribution on the downstream side of the throat portion has a curved line whose inclination has a positive value.

Figure 4:
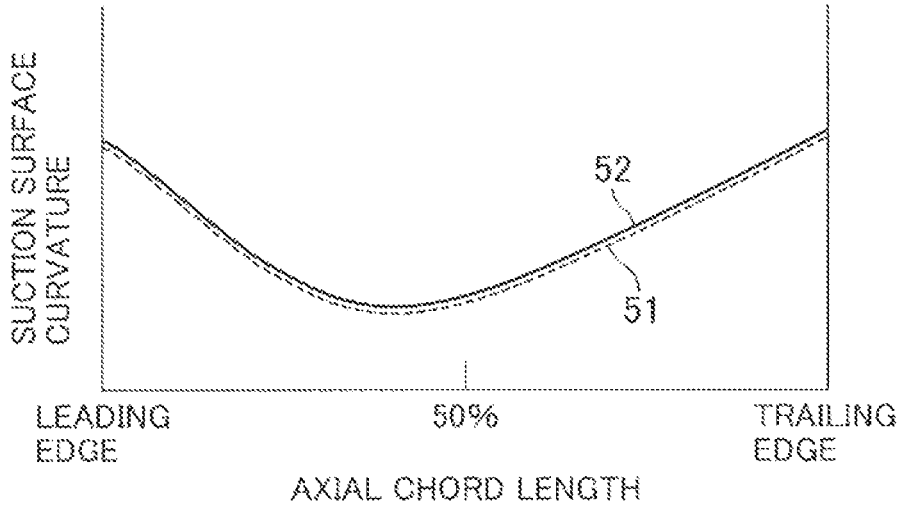
FIG. 4A is a curvature distribution chart of a suction surface of a vane according to the first embodiment of the invention.
FIG. 4B is a curvature distribution chart of a pressure surface of the vane according to the first embodiment.
Figure 4:
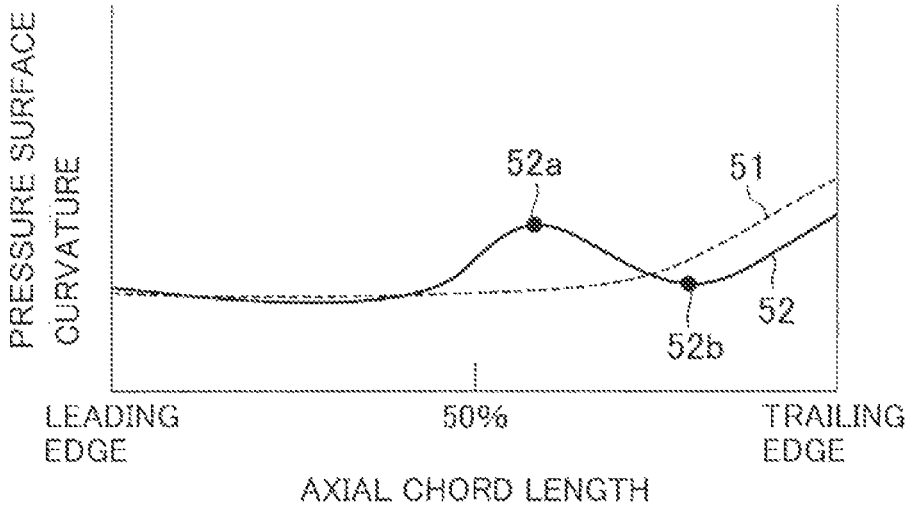

The vane shape in FIG. 3 is next described using a distribution of a vane surface curvature in FIG. 4. FIGS. 4A and 4B show comparison between a surface curvature distribution 52 of the vane of the first embodiment of the present invention indicated with a solid line and a surface curvature distribution 51 of the traditional vane indicated with a dotted line. FIG. 4A shows a surface curvature distribution of a suction surface of the vane and FIG. 4B show a surface curvature distribution of a pressure surface. Incidentally, a position where the curvature is minimized in FIG. 4A corresponds to a throat portion where flow is most accelerated. As shown in FIG. 4B, the vane of the present embodiment is formed to have the curvature distribution in which the pressure surface once has a local maximum value 52*a* on the downstream side of the throat portion about the axial direction and then has a local minimum value 52*b*. It is preferred that the local maximum value 52*a* be within a chord length range from 50% to 70%. In the present embodiment, the curvature of the suction surface is identical to that of the traditional vane, that is, the vane surface curvature distribution is monotonously increased.

Figure 5:
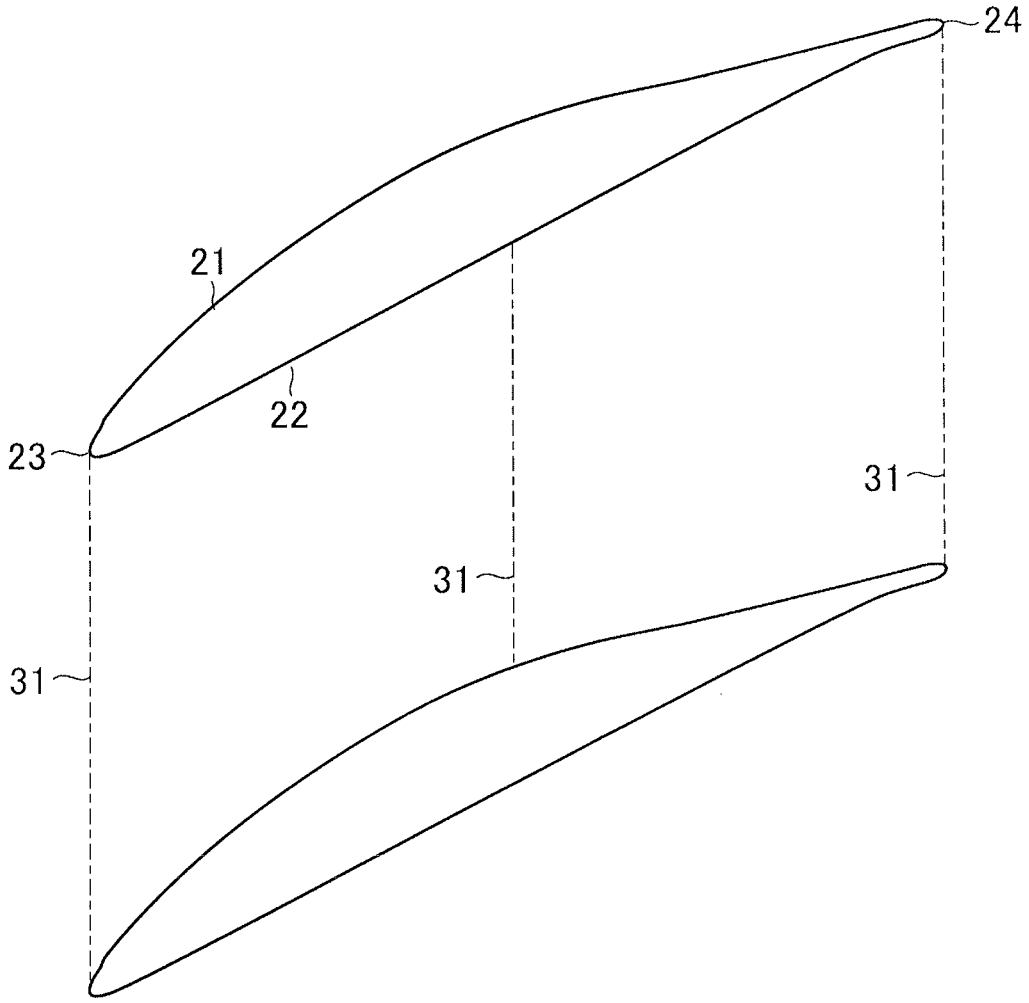
FIG. 5 is a two-dimensional cross-sectional view of axial compressor airfoils according to a second embodiment of the present invention.

A vane shape of the axial compressor according to a second embodiment of the present invention is shown in FIG. 5. Similarly to FIG. 3, FIG. 5 illustrates a cylindrical section of two vane shapes circumferentially adjacent to each other, taken along the A-A section of the stator vane 5 of FIG. 2. The vane shape is composed of a suction surface 21, a pressure surface 22, a leading edge 23 and a trailing edge 24. The vane of the present embodiment shown in FIG. 5 is different in the following point from that of the first embodiment shown in FIG. 3. As a method for increasing the flow path width distribution more on the downstream side of the throat portion about the axial direction shown in FIG. 1 than the traditional vane, not the curvature of the pressure surface 22 but the curvature of the suction surface 21 is increased on the downstream side of the throat portion.

However, also the vane shape shown in the present embodiment has the same flow path width distribution, shown in FIG. 1, of the flow path defined between the vanes adjacent to each other as that shown in the first embodiment.

Figure 6:
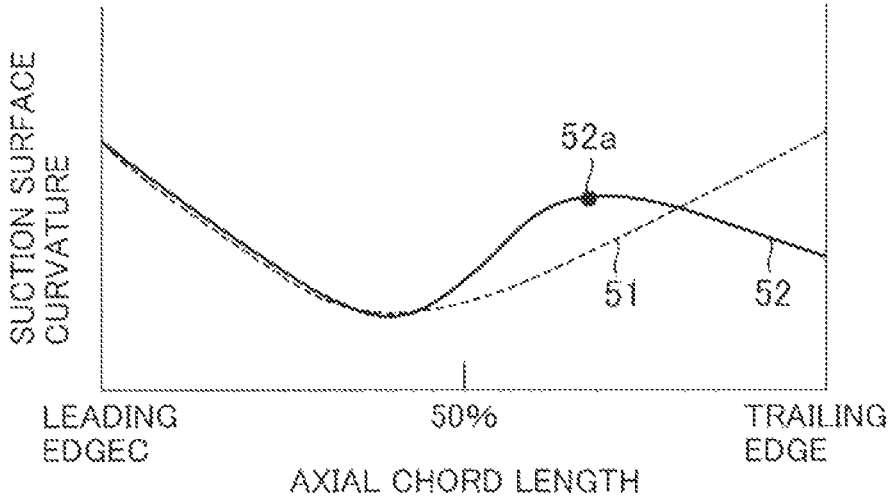
FIG. 6A is a curvature distribution chart of a suction surface of a vane according to the second embodiment of the present invention.
FIG. 6B is a curvature distribution chart of a pressure surface of the vane according to the second embodiment.
Figure 6:
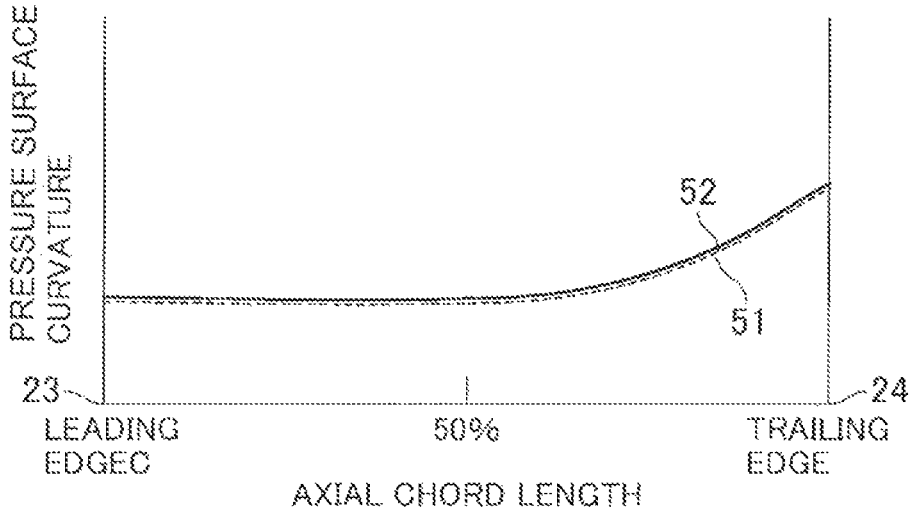

FIGS. 6A and 6B show a surface curvature distribution of the vane (FIG. 5) of the present embodiment. FIGS. 6A and 6B show comparison between a surface distribution 52 of the vane of the present embodiment indicated with a solid line and the surface curvature distribution 51 of the traditional vane indicated with a dotted line.

Incidentally, FIG. 6A shows a surface curvature distribution of a suction surface of the vane and FIG. 6B show a surface curvature distribution of a pressure surface. The vane of the present embodiment has the same pressure surface curvature as that of the traditional vane. On the other hand, the suction surface side curvature of the vane of the present embodiment is formed to have such a curvature distribution as to have once a local maximum value 52*a* on the downstream side of the throat portion of the axial chord length. In addition, the curvature is allowed to moderately reduce from the local maximum value 52*a* toward the trailing edge. It is preferred that the local maximum value 52*a* be in a range of chord length from 50% to 70%.

Incidentally, the general vane structure has a pressure surface and a suction surface which are smoothly joined together. To be exact, therefore, the curvature distribution exhibits an abrupt variation at a surface position close to the leading edge 23 and to the trailing edge 24. However, no reference is particularly made to such a joint portion in the figure.

The first and second embodiments describe the case where the curvature distribution of one of the pressure surface and the suction surface is varied to satisfy the flow path width distribution 42 in the axial direction of the vane shown in FIG. 1. It is possible to combine both of them. Specifically, it is possible to concurrently adopt the curvature distribution of the pressure surface described in the first embodiment and the curvature distribution of the suction surface described in the second embodiment. This can make it possible to satisfy the flow path width distribution as shown in FIG. 1. However, in that case, it is necessary to make the width of the vane on the downstream side of the throat portion of the axial chord length greater than the trailing width of the vane in view of the strength and reliability of the vane.

A description is next given of how the adoption of the vane structure described in the embodiments acts on a flow field. Specifically, the vane structure is such that the throat portion at which the flow path width is minimized is provided on the upstream side of 50% of the axial chord length, and the axial flow path width distribution extending from the leading edges to the corresponding trailing edge of the vanes defining the flow path therebetween has an inflection point on the downstream side of the throat portion. Incidentally, such a vane is called the vane embodying the invention in some cases for simplification.

FIG. 7A shows a static pressure distribution between two vanes adjacent to each other. FIG. 7B is a conceptual diagram of the static pressure distribution on a vane surface. A solid line in FIG. 7A indicates an equal-pressure line 61 and a dotted line indicates a pressure gradient 62 of the equal-pressure line in cross-section in a direction perpendicular to a flow along the pressure surface. In addition, FIG. 7A indicates an axial distance 65 determined from an intersection point 64 of the equal-pressure line 61 with the suction surface and an intersection point 63 of the equal-pressure line 61 with the pressure surface. In FIG. 7B, the axial distance 65 is indicated as a difference in axial position between the suction surface and the pressure surface at which their static pressure values are equal to that of the equal-pressure line.

The axial distance shown in FIG. 7B can be reduced by adopting the vane described above and by enlarging the flow path so that the flow path width distribution has the inflection point on the downstream side of the throat portion about the axial direction.

Reducing the axial distance 65 of the equal-pressure line as described above can substantially bring the equal-pressure line 61 and the pressure gradient 62 of the static pressure between the vanes shown in FIG. 7A into parallel to each other. This can reduce the pressure gradient in a direction perpendicular to the flow between the vanes. In this way, a cross flow occurring between the vanes can be controlled, whereby a secondary flow loss and corner stall can be reduced.

Further, the vane embodying the invention is configured so that the passage width distribution has the inflection point on the downstream side of the throat portion of the axial chord length. The throat portion is one in which the flow path width between the vanes is minimized to maximize the acceleration of the flow. In addition, the flow is decelerated on the downstream side of the throat portion so that static pressure is recovered (increased). Therefore, in the region where the flow is decelerated and the static pressure is increased, a turbulent boundary layer on the vane surface is developed so that the flow is likely to separate therefrom. Therefore, equalizing the static pressure gradient 62 between the vanes in that region is effective for lowering the secondary flow loss and for reducing the corner stall.

A plurality of cross-sections of the vanes described above are arranged in the vane-height direction and stacked one on another with their positions of the center of gravity aligned with each other. Thus, the three-dimensional vane can be designed. For example, the respective shapes of a 0%-section 71 on the casing side, a 50%-section of an average diameter and a 100%-section 72 on the rotor side are designed in the stator vane 5 shown in FIG. 2. In addition, the other sections are obtained by interpolation and the positions of the center of gravity of the vane shapes are stacked one on another. Thus, the three-dimensional vane can be designed. Alternatively, the vane shown in each of the embodiments is applied to the 0%-section 71 and 100%-section 72 which correspond to the endwall portions and the traditional vane is applied to the other cross-sections. In this way, the three-dimensional vane that can reduce only the secondary flow loss can also be designed.

Figure 8:
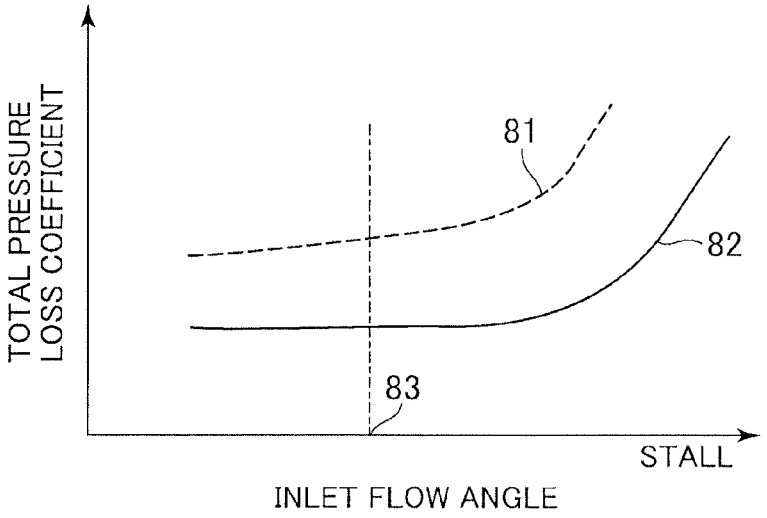
FIG. 8 shows comparison in total pressure loss coefficient with respect to an inlet flow angle between the vane embodying the invention and the traditional vane.

A description is given of an effect of the vane designed as described above on a three-dimensional flow field. FIG. 8 shows comparison between a total pressure loss coefficient 82 with respect to an inlet flow angle of the vane embodying the invention and a total pressure loss coefficient 81 with respect to an inlet flow angle of the traditional vane. The total pressure loss coefficient 82 is indicated with a solid line and the total pressure loss coefficient 81 is indicated with a dotted line. In addition, FIG. 8 indicates a design inlet flow angle 83 with a chain line. For the vane embodying the invention, the corner stall is controlled at the design inlet flow angle in FIG. 8; therefore, it can be confirmed that the total pressure loss can be more reduced than that of the traditional vane. In addition, it is seen that also on the stall side where the inlet angle is large, an increase in the total pressure loss is controlled. Therefore, the vane embodying the invention has a wide operating range, which allows for higher performance.

Figure 9:
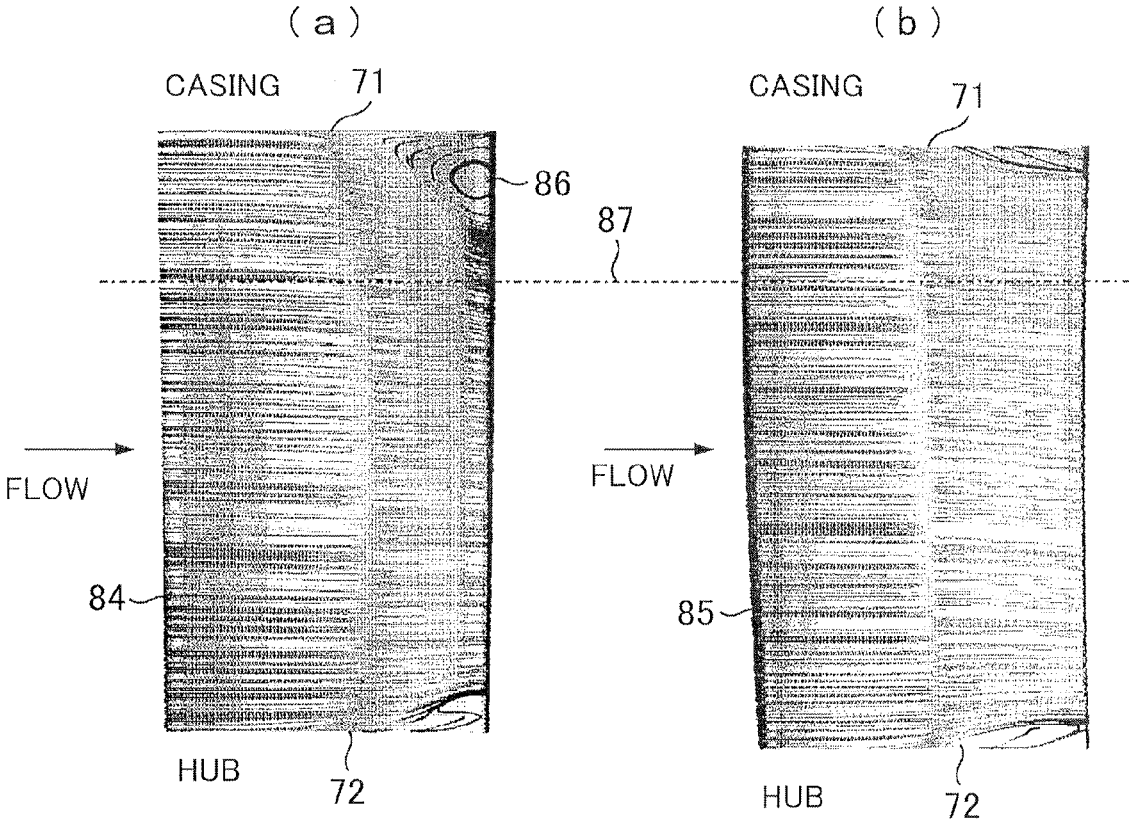
FIG. 9A shows streamlines close to a suction surface of the traditional vane.
FIG. 9B shows streamlines close to a suction surface of the vane embodying the invention.

FIGS. 9A and 9B show comparison between stream lines close to the respective suction surfaces of the vane 85 embodying the invention and the traditional vane 84. It can be confirmed that corner stall 86 occurs in which a flow is separated at positions close to both endwalls of the trailing edge in the flow field of the traditional vane in FIG. 9A. On the other hand, the corner stall is controlled on the vane embodying the invention. In particular, it can significantly be confirmed that a separation region is reduced at the 0%-section 71 located on the outer circumferential side.

Figure 10:
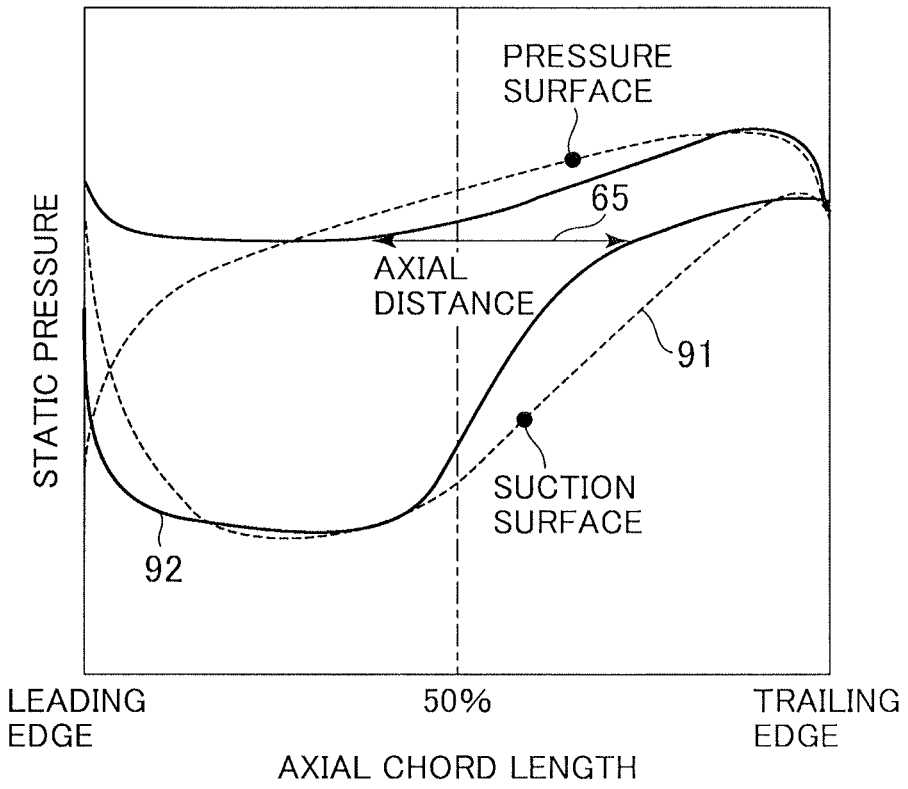
FIG. 10 shows comparison in a static pressure distribution of a vane surface with respect to axial chord length from a leading edge to a trailing edge between the vane embodying the invention and the traditional vane.

FIG. 10 shows static pressure distributions at cross-sections 87 indicated with the chain line shown in FIGS. 9A and 9B. These cross-sections are selectively represented by the casing side cross-section that is less affected by the corner stall at a position close to the endwall of the traditional vane. FIG. 10 shows a static pressure distribution of a vane surface with respect to the axial chord length from the leading edge to the trailing edge. A dotted line indicates a static pressure distribution 91 of the traditional vane and a solid line indicates a static pressure distribution 92 of the vane embodying the invention. For the vane embodying the invention, the static pressure of the suction surface is significantly increased on the downstream side of 50% of the chord length. This corresponds to the increased curvature of the suction surface. Further, the variation of the static pressure is made moderate on the downstream side of 70% of the chord length of the suction surface. This is achieved by reducing the curvature of the suction surface. It is confirmed that the axial distance 65 between the intersection of the equal-pressure line with the pressure surface and the intersection of the equal-pressure line with the suction surface can be shortened, as compared with the traditional vane, on the downstream side of the throat portion of the blade passage located close to 30% of the chord length of the vane embodying the invention. Since such a static pressure distribution can be achieved, the inter-vane static pressure can be equalized at a cross-section in a direction perpendicular to the flow, thereby controlling a cross flow.

The vane embodying the invention configured as described above can reduce the secondary flow loss and achieve the higher efficiency of the axle compressor. Since the vane embodying the invention can control the corner stall, the outlet flow angle can be brought closer to the design value compared with the traditional vane. Therefore, matching with respect to the rotor blades or stator vanes located on the downstream side can be improved. Thus, even multistage vanes or blades can be made to have high performance. Further, unsteady fluid vibrations such as buffeting or the like due to the turbulence or the like of a flow on the vane surface can be avoided and the reliability of the vane can be improved.

A general method of enhancing the performance of the traditional vane to reduce a secondary flow loss includes the following means. For example, a stagger angle of the endwall portion of the stator vanes is increased to reduce a loading on the endwall portion, thereby controlling corner stall. To arrange stator vanes on a casing, since a shroud portion is installed on the endwall, it is necessary to provide a fillet on the endwall portion of the stator vane and fully mount the endwall portion on the shroud portion. If the staggered angle of the endwall portion is increased as described above, the vane shape may probably protrude from the shroud portion or the fillet portion may probably partially be excluded. However, the vane embodying the present invention has almost the same staggered angle of the endwall portion as that of the traditional vane. Therefore, the shroud portion can be shared and the reliability of the vane can be ensured.

A description is next given of a profile creation method of the vane embodying the present invention.

To create a two-dimensional cross-sectional profile of the vane, a peak Mach number on a suction surface and a shape factor of the suction surface are generally evaluated and the vane profile is created so as to minimize the peak Mach number and the shape factor. Incidentally, the shape factor is represented by a ratio of displacement thickness to momentum thickness on a surface boundary layer and serves as an index for indication of separation on the boundary layer. It is known that flow generally separates on the turbulent boundary layer at a shape factor of 1.8 to 2.4 or more.

Figure 7:
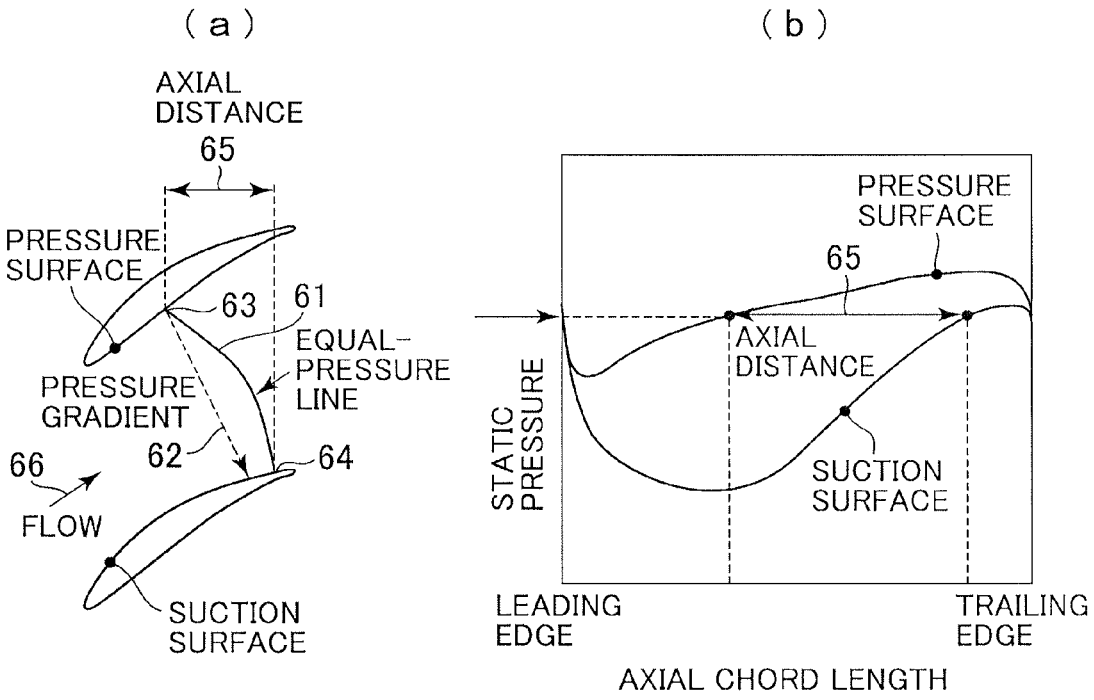
FIG. 7A shows a static pressure distribution between two vanes adjacent to each other.
FIG. 7B is a conceptual diagram of the static pressure distribution on a vane surface.

The axial distance of the equal-pressure line which is an index allowing for the three-dimensional flow field is added to create the two-dimensional cross-sectional profile of the vane embodying the invention (FIG. 7). An objective function F for creating the vane embodying the invention is represented by expression (1), where F1 is a shape factor, F2 is a peak Mach number and F3 is an axial distance of the equal-pressure line.

These indexes are each subjected to a dimensionless conversion using a ratio with a corresponding reference value. Symbols α, β and γ are weighting factors.

To create the two-dimensional cross-sectional profile of the vane, the high performance profile concurrently allowing for the profile loss and the secondary flow loss can be created by minimizing the objective function F shown in expression (1).

[Expression 1]

$$F = \alpha\frac{F_1}{F_{1_base}} + \beta\frac{F_2}{F_{2_base}} + \gamma\frac{F_3}{F_{3_base}} \tag{1}$$

The embodiments of the present invention describe the stator vane of the subsonic stage located on the downstream side portion in the axial compressor and its function and effect. However, the present invention can applied to the design of a transonic airfoil located on the upstream side in the compressor and of a high subsonic airfoil located at an intermediate stage by changing the weighting factors in expression (1). It is clear that the same function and effect can be provided by applying the present invention to not only the stator vane but the rotor blade.

It is possible to design an arbitrary airfoil shape from the upstream side to the downstream side in the compressor by incorporating the indexes shown in expression (1) into a design system. This has also an effect of cutting design time. It is possible to design the airfoil shape uniquely without depending on a designer for higher performance of the airfoil.

The present invention can be applied to axial compressors for industrial applications as well as for gas turbines.

What is claimed is:

1. An airfoil designing method in which an axial compressor includes a plurality of stator vanes attached to an inner surface of a casing defining an annular flow path and a plurality of rotor vanes attached to a rotating rotor defining the annular flow path, and a flow path is defined between a pressure surface of a stator vane and a suction surface of a stator vane, the vanes being circumferentially adjacent to each other, or between a pressure surface of a rotor blade and a suction surface of a rotor blade, the blades being circumferentially adjacent to each other, the method comprising the steps of:

adopting a design index on the downstream side of a throat portion at which a width of the flow path is minimized, the design index including a dimensionless value by a ratio of an axial distance and a corresponding reference value, the axial distance being a distance between a point where an equal-pressure line intersects the pressure surface and another point where the equal-pressure line intersects the suction surface; and designing so that the equal-pressure line approximates a line in a direction perpendicular to a flow along the pressure surface by reducing the axial distance.

2. The airfoil designing method according to claim 1, wherein different design index values are added to create a two dimensional cross-sectional profile of a given stator vane.

3. The airfoil designing method according to claim 2, wherein the two dimensional cross-sectional profile of the given stator vane is calculated in accordance with the following expression:

$$F(\text{objective})=\alpha(F_1/F_{1_base})+\beta(F_2/F_{2_base})+\gamma(F_3/F_{3_base}),$$

where $F_1$ is a shape factor, $F_2$ is a peak mach number, $F_3$ is an axial distance of the equal-pressure line, and α, β, γ are weigh factors.

4. The airfoil designing method according to claim 3, wherein the F(objective) is minimized to obtain a high performance profile.

* * * * *